US006773015B2

(12) United States Patent
Long et al.

(10) Patent No.: US 6,773,015 B2
(45) Date of Patent: Aug. 10, 2004

(54) APPARATUS AND METHOD FOR PLAYING A TOSS GAME

(75) Inventors: John Michael Long, Spokane, WA (US); John T. Van, Bigfork, MT (US)

(73) Assignee: Double Long Enterprises, LLC, Spokane, WA (US)

( * ) Notice: Subject to any disclaimer, the term of this patent is extended or adjusted under 35 U.S.C. 154(b) by 0 days.

(21) Appl. No.: 10/342,869

(22) Filed: Jan. 13, 2003

(65) Prior Publication Data

US 2004/0135318 A1 Jul. 15, 2004

(51) Int. Cl.[7] ..... A63B 67/00
(52) U.S. Cl. ..... 273/343
(58) Field of Search ..... 273/343, 401, 273/398, 399, 400, 402; 473/514

(56) References Cited

U.S. PATENT DOCUMENTS 2,797,924 A 7/1957 Stewart
3,701,531 A 10/1972 Bowers
3,717,348 A * 2/1973 Bowers ..... 473/514
4,487,419 A * 12/1984 Welbourn ..... 273/343
5,165,694 A 11/1992 Kraushaar
5,522,597 A 6/1996 Hanks
6,308,956 B1 * 10/2001 Reid ..... 273/343
2002/0084588 A1 * 7/2002 Lynch ..... 273/343
2003/0098545 A1 * 5/2003 Webb ..... 273/343

* cited by examiner

*Primary Examiner*—Mark S. Graham
(74) *Attorney, Agent, or Firm*—Robert Ryan Morishita; Anderson & Morishita, LLC

(57) ABSTRACT

An apparatus for playing a toss game includes a projectile consisting of two weights connected by a tether and a stand. The stand includes a base supporting a goal. The goal includes at least two crossbars, each of which is assigned a point value. A method of playing a toss game is played in series. A series consists of competitors tossing a predetermined number of projectiles at the goal. The competitors score points with projectiles by looping over, wrapping around, or intersecting crossbars. Points are deducted if a projectile is dislodged from the goal. Competitors attempt to obtain an aggregate score equal to a target value. Procedures for resolving ties and tosses that cause competitors to exceed the target value may be employed.

16 Claims, 5 Drawing Sheets

APPARATUS AND METHOD FOR PLAYING A TOSS GAME

FIELD OF THE INVENTION

The present invention is a toss game. More specifically, the present invention is an apparatus and method for playing a toss game in which projectiles are tossed at a goal with the purpose of obtaining a pre-determined target score and, in an optional embodiment, preventing other competitors from obtaining a predetermined target score.

BACKGROUND OF THE INVENTION

Toss games are well known in the art. Examples of known toss games are horseshoes and ring toss games, where players toss U-shaped or circular projectiles, respectively, at a vertical stake. In such games, players are typically rewarded for striking the target but may also be rewarded based on the proximity of the projectile to the stake.

One toss game is disclosed in U.S. Pat. No. 5,882,010 to Geror. Geror discloses a game in which flat rings are tossed at a target with the shape of a square tray with a central cup. Players alternate tossing rings at the target and score points for tossing rings into the central cup, into the square tray, adjacent, but not in, the square tray, or outside the square tray but within one foot of the target.

The drawback of Geror and other toss games is that projectiles are used only offensively to score points. More specifically, projectiles in such games are not used defensively to prevent the other participants from scoring points or subtract points from other participants' scores.

Another example of an apparatus for a toss game is disclosed in Reid, U.S. Pat. No. 6,308,956. Reid utilizes projectiles consisting of balls secured at the ends of a tether that are tossed at a ladder with removable rungs. The shortcoming of Reid, however, is that while Reid illustrates projectiles draped over the rungs, it does not disclose how points-are scored or the method of play of such a toss game. Additionally, Reid discloses that projectiles can be draped over the rungs but shows spacing between the rungs that would probably not allow the projectiles to wrap around the rungs.

SUMMARY OF THE INVENTION

An apparatus for a toss game includes a projectile and a stand. The projectile includes two weights connected to one another by a flexible tether. Optionally, the weights are secured on the tether but left free to move along the tether. The stand includes a base resting on a surface and a goal extending upward from the base. The goal includes a pair of uprights with at least two crossbars connecting the uprights. In an optional embodiment, where the total length of the projectile is given as L, the spacing between the crossbars is greater than or equal to L/2 such that the projectile is free to wrap around a crossbar without striking an adjacent crossbar when the midpoint of the tether strikes a crossbar.

A method of playing a toss game between at least two competitors, either individual players or teams of players, with the apparatus described above begins with providing at least one projectile and at least one stand. In an optional embodiment, a set one or more projectiles is provided to each competitor. Each of the crossbars is assigned a point value. Optionally, the point value for each crossbar is different. In a further optional embodiment, the point values vary inversely with the distance from the surface the base rests on. For example, if three crossbars are provided, the lowest crossbar may have the highest point value, the highest crossbar may have the lowest point value, and the middle crossbar may have an intermediate point value, in such an optional embodiment. In yet another optional embodiment, one or more of the point values may be increased if a projectile bounces off the surface before looping over, wrapping, or intersecting a crossbar.

Play according to the method is conducted in discrete units called series. Each series includes each competitor tossing one or more projectiles at the goal until all competitors have each tossed a predetermined number of projectiles. In an optional embodiment utilizing sets of projectiles, each competitor may in turn toss a complete set. After all competitors have tossed the predetermined number of projectiles, an aggregate score is calculated for each competitor. The aggregate score is equal to the aggregate score from a previous series of play, if any, plus the point values for each crossbar a projectile looped over or wrapped minus the point values for any projectile dislodged from the stand. In an optional embodiment, points may also be added for crossbars intersected by projectiles looped or wrapped around an upright. If any competitor has an aggregate score equal to a predetermined target value, the competitor wins. Otherwise, additional series of play are conducted until at least one competitor has reached an aggregate score equal to the target value. In other words, the goal is to have an aggregate score equal to a target value at completion of a series after all the competitors have tossed the predetermined number of projectiles.

It is contemplated that a projectile tossed during a series causes a competitor to exceed the target value could be handled in a number of different ways. For example, in one optional embodiment, the point value received on the exceeding toss, or the points received in the entire series, is not used in calculating the competitor's aggregate score and play is terminated for that particular competitor for the remainder of that series. In another optional embodiment, the point value received on the exceeding toss is not used in calculating the competitor's aggregate score but the competitor is permitted to continue playing the series until the competitor has tossed the predetermined number of projectiles. In yet another optional embodiment, the point value earned on the exceeding toss, or the points earned in the entire series, is not included in calculating the competitor's aggregate score and the competitor's aggregate score is reduced by the point total of the exceeding toss. Play is also terminated for the competitor for the remainder of that series.

It is also contemplated that a number of methods could be used to resolve ties. That is, if, at the completion of a series of play, two or more competitors have an aggregate score equal to the predetermined target value the game could be resolved in any number of ways. For example, in an optional embodiment, a playoff series could be conducted. In one optional playoff series, each tied competitor tosses a predetermined number of projectiles. In a further embodiment, each tied competitor serially tosses a single projectile until each tied competitor has tossed a predetermined number of projectiles.

After all tied competitors have tossed the predetermined number of projectiles, a playoff score is calculated. The playoff score is equal to the point values for each crossbar a projectile looped over, wrapped, or intersected minus the point values for any projectile dislodged from the stand by another projectile. The competitor with the highest playoff score wins. If a playoff series ends with two or more competitors with tied playoff scores, in an optional embodiment, additional playoff series are conducted with all tied competitors.

DESCRIPTION

Figure 1:
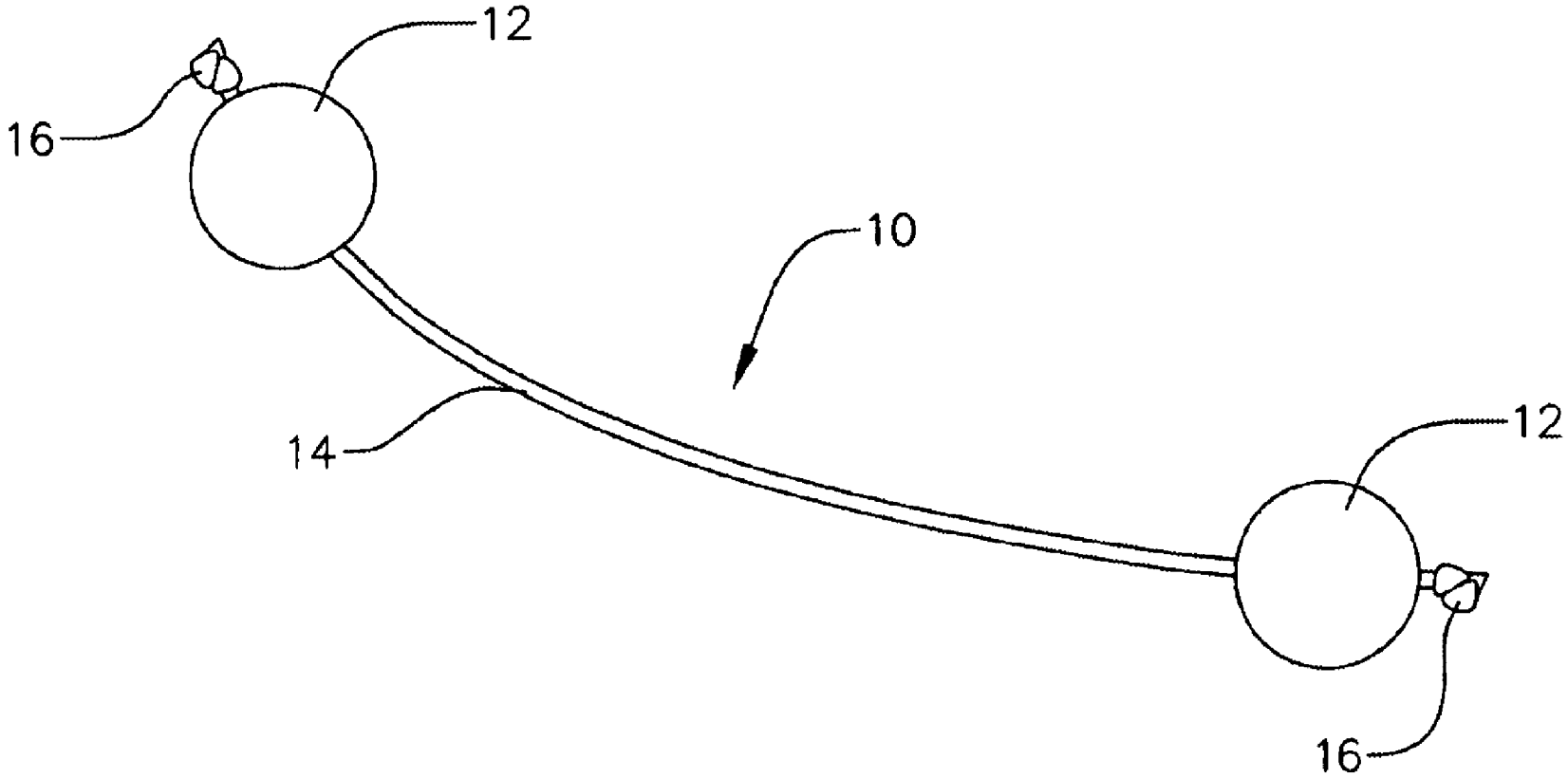
FIG. 1 shows a front view of a projectile according to an embodiment of the present invention.
Figure 2:
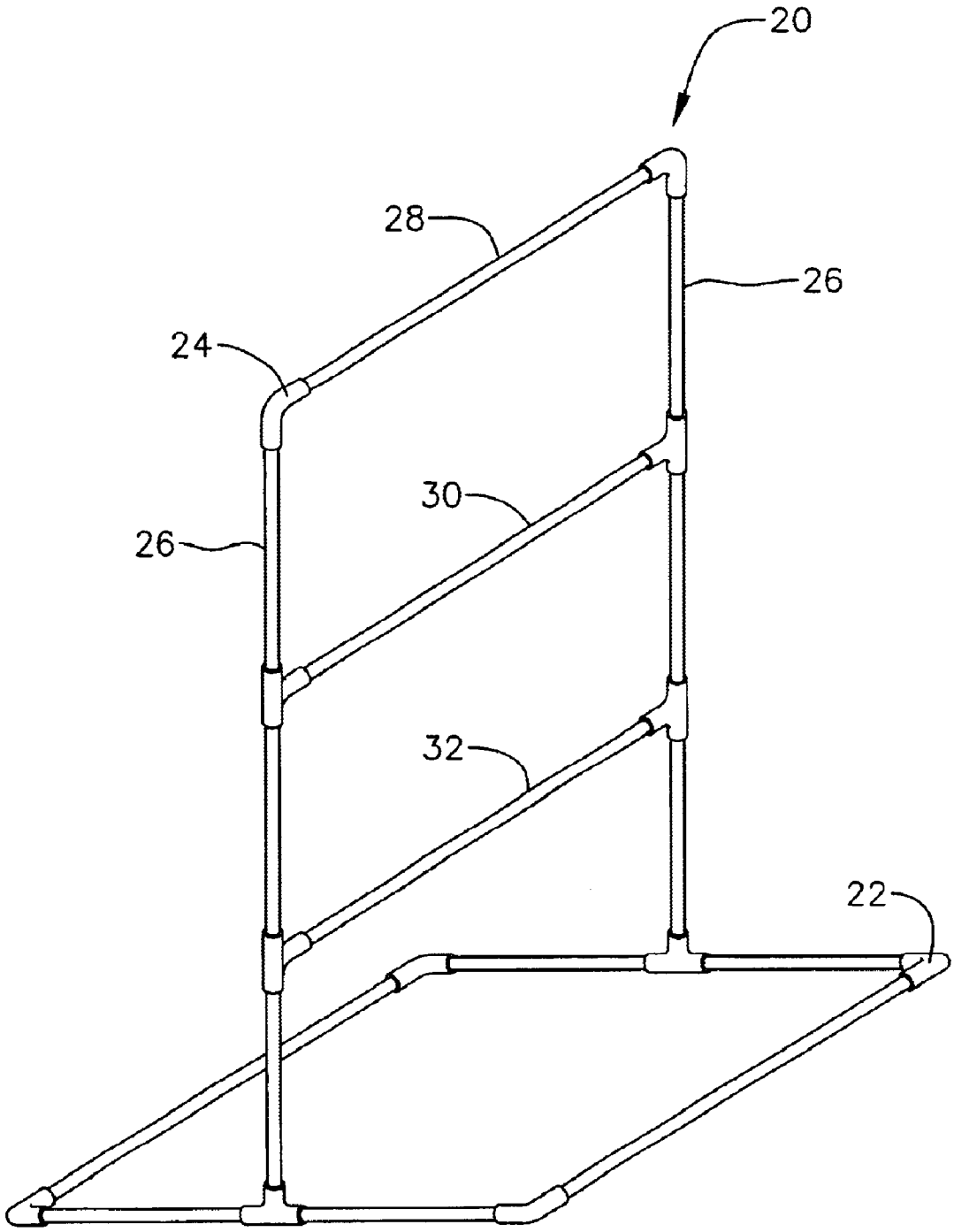
FIG. 2 shows an elevated perspective view of a stand according to an embodiment of the present invention.
Figure 3:
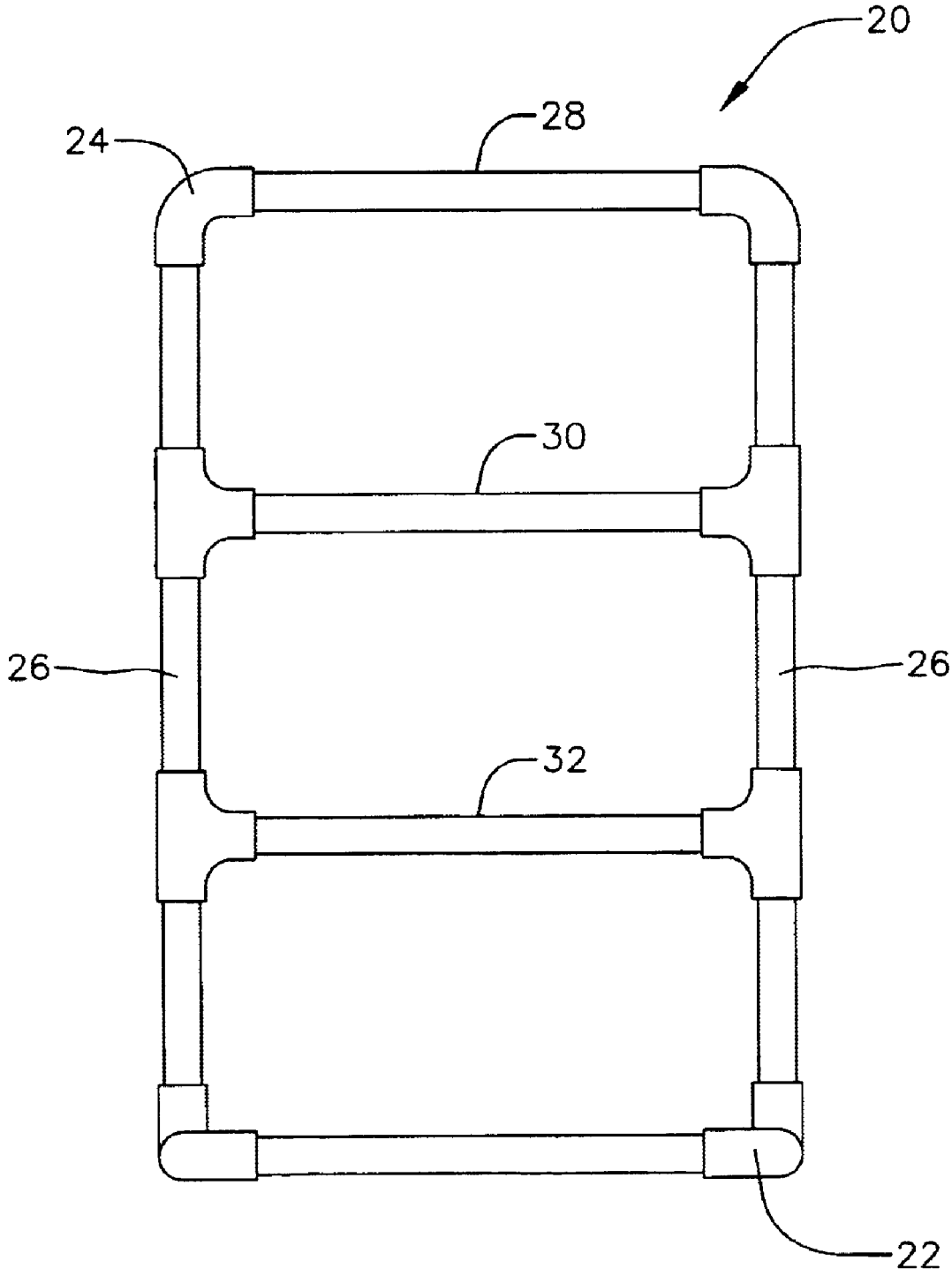
FIG. 3 shows a front view of a stand according to an embodiment of the present invention.

Reference is now made to the figures wherein like parts are referred to by like numerals throughout. Referring first to FIGS. 1–3, the present invention includes an apparatus for playing a toss game. Shown in FIG. 1 is a projectile 10 according to an embodiment of the present invention. The projectiles includes two weights 12 connected to one another by a tether 14. The weights 12 are optionally spherical, such as balls, and optionally formed from a resilient material that has at least some ability to bounce. For example the weights 12 could be golf balls.

The weights 12 are secured to one another using a tether 14. The tether 14 is a flexible material such as rope or cord formed from a natural or synthetic material. The tether 14 in an optional embodiment is diamond braid nylon cord that provides an amount of rigidity yet is flexible enough to permit the tether 14 to wrap around the goal as described below.

In an optional embodiment, the tether 14 and weights 12 are connected by running the tether 14 through a through-hole in the weights 12 and knotting 16 the tether or otherwise preventing the weights 12 from sliding off the ends of the tether 14. It is important to note that it is contemplated that in an optional embodiment, the weights 12 are prevented from sliding off the tether 14 but may be left free to slide along the tether 14. In other words, in the optional embodiment of FIG. 1, the tether 14 is only knotted 16 to one side, the end-side, of the weights 12 but not to the other side, the inside, of the weights 12. Thus, in such an optional embodiment, nothing prevents the weights 12 from sliding away from the ends of the tether 14 except whatever centripetal forces may be exerted on the weights 12 by the spin, if any, imparted during a toss.

Shown in FIGS. 2 and 3 is a stand 20. The stand 20 includes a base 22 and a goal 24 extending upward from the base 22. As shown in the optional embodiment of the figures, the base 22 is optionally quadrilateral, such as a square or rectangle, although it is contemplated that the base 22 could take any shape capable of supporting the goal 24.

With continued reference to FIGS. 2 and 3, the goal 24 includes uprights 26 extending away from the base 22 and at least two crossbars 28 connecting the uprights 26. The uprights 26 themselves may take many different forms and may not necessarily be straight, parallel, coplanar, or of equal height.

In the optional embodiment of the figures, three crossbars 28, 30, 32 are disposed between the uprights 26. The crossbars 28, 30, 32 shown in the optional embodiment of the figures are parallel to one another and perpendicular to the uprights 26. However, it is not necessary that the crossbars 28, 30, 32 be straight, parallel, coplanar, of equal length, or perpendicular to the uprights 26. While the crossbars 28, 30, 32 could be spaced at any distance, in one optional embodiment in which the total length of a projectile 10 is equal to L, the distance between a crossbar 28, 30, 32 and an adjacent crossbar 28, 30, 32 is at least L/2 such that the projectile 10 may wrap around a crossbar 28, 30, 32 without striking an adjacent crossbar 28, 30, 32 when the midpoint of the tether 14 strikes the crossbar 28, 30, 32.

The stand 20 is optionally formed from pipe fitted together with joints. While any material could be used, such as polymers, metal, or other natural or synthetic materials, schedule 40 polyvinylchloride ("PVC") polymer pipe is utilized in an optional embodiment. PVC is used in an optional embodiment because of its weather resistance, and strong, yet elastic, material properties. Again, however, any material that can withstand impact from the projectiles 10 would be suitable for use in the stand 20.

The present invention further includes a method of playing a toss game using a projectile 10 and stand 20 like that discussed above. The method is played between two or more competitors. It is contemplated that a competitor could be a single player or a team of players. The number of competitors playing the game could be any number but for simplicity, the examples below will be utilize two or three competitors. These exemplary embodiments should not be considered limiting in any way.

Figure 4:
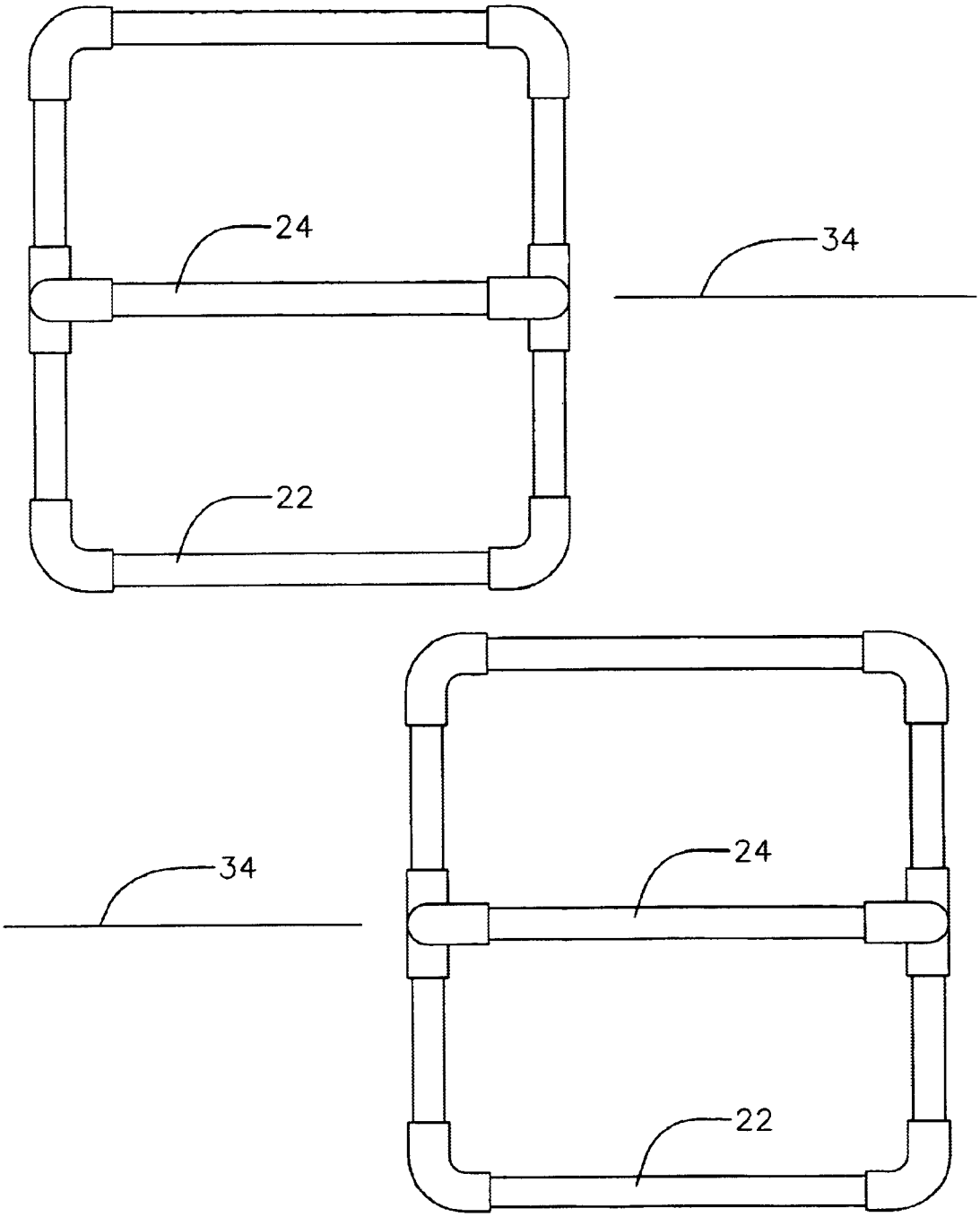
FIG. 4 shows a top view of a course according to an embodiment of the present invention.

With reference to FIG. 4, a course is constructed by setting the stand 20 on a surface. While it is contemplated that any surface could be used, in an optional embodiment a surface that is flat and firm to permit some bouncing of the projectiles 10. The stand 20 is positioned at a predetermined distance from the competitors. In the optional embodiment of the figures, the competitors stand twenty-five feet from the stand 20 on a line perpendicular to the plane formed by the uprights 26. During play, the predetermined distance may optionally be maintained by marking the position of the stand 20 and marking a foul line 34 for the competitors.

Optionally two stands 20 are placed parallel to one another at the predetermined distance so that competitors completing a series by tossing at a first stand 20 can commence the subsequent series by retrieving the projectiles 10 from the first stand 20 and tossing at a second stand 20. To give the players room to toss the projectiles 10, the stands 20 may optionally be offset from one another and the foul line 34 may optionally extend from each stand 20.

Figure 5:
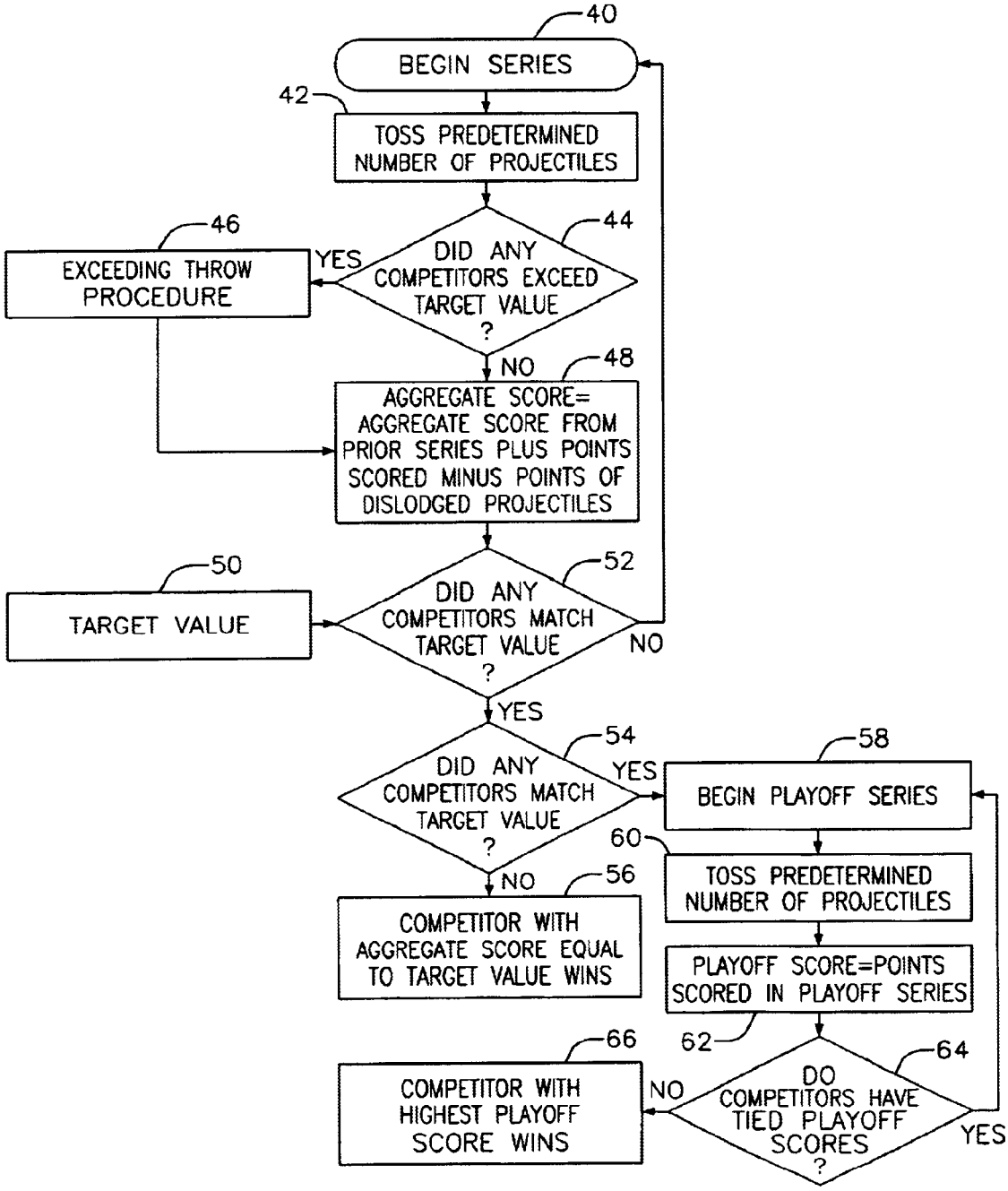
FIG. 5 is a flowchart of a game method according to an embodiment of the present invention.

Referring to FIG. 5, play is conducted in one or more series 40. A series is completed when all competitors have each tossed 42 a predetermined number of projectiles 10. A number of series 40 may be required for resolution of a game. Additionally, a playoff series 58, explained in greater detail below, may also be needed to resolve a game.

In tossing the projectiles 10 in a series 40, competitors may take turns tossing 42 projectiles 10 or, alternatively, each competitor may toss 42 a set of one or more projectiles 10 before completing the competitor's turn in the series 40. For example, in one optional embodiment, a series 40 consists of each competitor tossing 42 a set of three projectiles 10 at the goal 24. After a competitor tosses 42 his or her set of projectiles 10, the player is finished for that series 40.

Each crossbar 28, 30, 32 is assigned a point value. Optionally each crossbar 28, 30, 32 is assigned a different point value. In a further optional embodiment, the point value of the crossbar 28, 30, 32 varies inversely with the distance of the crossbar 28, 30, 32 from the base 22 resting on the surface. For example, in one optional embodiment having three crossbars 28, 30, 32, such as that shown in FIGS. 2 and 3, a higher crossbar 28 is assigned a point value of one, a middle crossbar 30 is assigned a point value of two, and a lower crossbar 32 is assigned a point value of three. It is contemplated that the point value need not remain static across series and that the point values may change from series to series.

Points are scored with projectiles 10 by looping a projectile 10 over, or wrapping a projectile 10 around, a crossbar 28, 30, 32. In an optional embodiment, points may also be scored by looping a projectile 10 over, or wrapping a projectile 10 around, an upright 26 such that the projectile 10 intersects a crossbar 28, 30, 32. In such an optional embodiment, points may be awarded even if the projectile 10 hangs to the outside of the goal 24, if the projectile 10 would intersect a crossbar 28, 30, 32 if extended. In a further optional embodiment, increased points are awarded for bouncing the projectile 10 before looping over, wrapping around, or intersecting a crossbar 28, 30, 32. For example, if a competitor bounces a projectile 10 and the projectile 10 wraps around any crossbar 28, 30, 32, five points may be scored. Thus, the following optional score table could be constructed for an embodiment including three crossbars 28, 30, 32.

TABLE 1

| Action | Point Value |
|---|---|
| Loop over, wrap around, or intersect higher crossbar | 1 point |
| Loop over, wrap around, or intersect middle crossbar | 2 points |
| Loop over, wrap around, or intersect lower crossbar | 3 points |
| Bounce then loop over, wrap around, or intersect any crossbar | 5 points |

In a series, each competitor earns an aggregate score 48. In an initial series 40, the aggregate score 48 is the sum of all the point values of the crossbars 28, 30, 32 that the competitor's projectiles 10 loop over, wrap around, or intersect. In subsequent series 40, the aggregate score 48 is the sum of the aggregate score from the preceding series and the point values of the crossbars 28, 30, 32 that the competitor's projectiles 10 loop over, wrap around, or intersect.

In calculating the aggregate score 48, it is important to note that any points scored by a projectile 10 are not counted toward the aggregate score 48 if the projectile 10 is dislodged. Put another way, if a projectile 10 scores by wrapping around a crossbar 28, 30, 32, and that projectile 10 is dislodged later in the series 40 from a crossbar 28, 30, 32, such as by another competitor's projectile 10, then those points originally earned by projectile 10 are subtracted from the competitor's aggregate score 48. For example, assume competitor A and competitor B are playing a series 40. Competitor A tosses 42 three projectiles 10 and scores nine points by wrapping all three projectiles 10 around a lower crossbar 32. In tossing 42 his projectiles 10, competitor B dislodges one of competitor A's projectiles 10 from the lower crossbar 32. Competitor A's aggregate score 48 at the end of the series is six because the points earned by the dislodged projectile 10 are not included in competitor A's aggregate score 48.

The object of a game is to finish a series with an aggregate score 48 equal 52 to a predetermined target value 50. Several series may be played before one or more competitors to reach an aggregate score 48 equal 52 to the target value 50. In an optional embodiment, the target value 50 is twenty-one points, although any target value 50 could be used.

During the course of a series, it is possible that a competitor may toss a projectile 10 that results in the competitor's aggregate score 48 to exceed 44 the target value. A number of different "exceeding toss" procedures 46 could be employed to handle the situation. In an optional embodiment, the point value received on the exceeding toss is not counted toward the competitor's aggregate score but the competitor is permitted to continue tossing projectiles 10 until the competitor has tossed the predetermined number of projectiles 10 for that series. For example, in a series where each competitor tosses three projectiles 10, if competitor A has an aggregate score of twenty points and competitor A tosses a first projectile 10 that scores three points, the three points are not counted toward competitor A's aggregate score but competitor A is allowed to toss his or her two remaining projectiles 10 to attempt to score the one point required.

In another optional embodiment, the exceeding toss is not counted toward the competitor's aggregate score and play for the competitor in the series is terminated even if the competitor has projectiles 10 remaining. For example, in a series where each competitor tosses three projectiles 10, if competitor A has an aggregate score of twenty points and competitor A tosses a second projectile 10 that scores two points, the two points are not counted toward competitor A's aggregate score and play is terminated for competitor A in that competitor A is not permitted to toss his or her remaining projectile 10.

In a related optional embodiment, when a competitor scores points that cause the aggregate score to exceed the target value, none of the points earned in the series are counted toward the competitor's aggregate score and play is terminated for the player in that series. For example, in a series where each-competitor tosses three projectiles 10, if competitor A has an aggregate score of sixteen points and competitor A tosses a first projectile 10 that scores three points and a second projectile 10 that scores three points, the six points earned in the series are not counted toward competitor A's aggregate score and play is terminated for competitor A even though the first projectile 10 did not cause the competitor to exceed the target value.

In yet another optional embodiment, the exceeding toss is not counted toward the competitor's aggregate score, play is terminated for the competitor in the series, and the points scored on the exceeding toss are deducted from the competitor's aggregate score. For example, in a series where each competitor tosses three projectiles 10, if competitor A has an aggregate score of nineteen points and competitor A tosses a first projectile 10 that scores three points, the three points are not counted toward competitor A's aggregate score, play is terminated for competitor A in that competitor A is not permitted to toss his or her two remaining projectiles 10, and the three points are deducted from competitor A's aggregate score such that competitor A's aggregate score at the end of the series is sixteen, that is, nineteen minus three.

Once again, a related optional embodiment for an "exceeding toss" is contemplated in which none of the points scored in a series are counted toward the competitor's aggregate score, play is terminated for the competitor in the series, and the points scored on the exceeding toss, or optionally the entire series, are deducted from the competitor's aggregate score. For example, in a series where each competitor tosses three projectiles 10, if competitor A has an aggregate score of nineteen points and competitor A tosses a first projectile 10 that scores three points, the three points are not counted toward competitor A's aggregate score, play is terminated for competitor A in that competitor A is not permitted to toss his or her two remaining projectiles 10, and the three points are deducted from competitor A's aggregate score such that competitor A's aggregate score at the end of the series is sixteen, that is, nineteen minus three.

As discussed above, if only one competitor ends a series with an aggregate score 48 equal to the target value 50, that competitor is the winner 56 of the game. In the event that two or more competitors finish a series with aggregate scores 48 equal 54 to the target value 50, a tie may be declared and a tie-breaking procedure may optionally be applied. While the tie result could stand or tie could be broken in any fashion, in an optional embodiment, a playoff series 58 is played in the event of a tie. In such an optional embodiment, the tied competitors toss 60 a predetermined number of projectiles 10. Optionally, tied competitors take turns tossing 60 a single projectile 10 until each tied competitor has tossed 60 the predetermined number of projectiles 10. For example, if competitor A and competitor B are tied, competitor A and competitor B alternate tossing 60 a single projectile 10 until both competitor A and competitor B have each tossed 60 three projectiles 10.

After the tied competitors have tossed 60 all the projectiles 10 permitted in the playoff series, a playoff score 62 is calculated by summing the point values of each crossbar 28, 30, 32 looped over, wrapped around, or intersected less the points for each projectile 10 dislodged. That is, as with a regular series, the points earned by a tossed projectile 10 is only included in the playoff score if the projectile 10 remains on the goal 24 at the end of the playoff series. If a projectile 10 scores but is dislodged, the dislodged projectile 10 earns no points for the playoff series 58. The tied competitor with the highest playoff score wins 66 the playoff series 58. In the event that a playoff series 58 ends with two or more competitors with the highest playoff scores in a tie 64, additional playoff series 58 may optionally be conducted. If more than two competitors participate in a playoff series 58, in an optional embodiment, all the tied competitors advance to an additional playoff series 58 even if only the highest two competitors tie in the playoff series 58. In other words, if the two competitors in a playoff series 58 finish the playoff series 58 with the highest playoff scores 64 are tied, all the competitors in the playoff series 58 compete in the additional playoff series 58 without regard to whether the other competitors tied 64 the highest score or not.

The principles of the game thus explained, the steps of a game will be described. A series begins 40 with the determination of the order in which competitors will toss projectiles 10. The order could be determined in any number of ways but it is contemplated that in an initial series, the order could optionally be determined randomly. In a further optional embodiment, the order in a series is in reverse order of aggregate score.

The competitors toss 42 projectiles 10 from the foul line to the goal 24. In an optional embodiment, the competitors may not cross the foul line 34 and each projectile 10 must travel at least half the distance to the goal 24. Points are scored for each projectile 10 that loops over, wraps around, or intersects a crossbar 28, 30, 32 and deducted for each projectile 10 dislodged from a crossbar 28, 30, 32. That is, each competitor's aggregate score 48 for a series is the sum of the competitor's aggregate score from the preceding series, if any, plus the points scored by projectiles 10 tossed by the competitor remaining on the goal 24, i.e. not dislodged from the goal 24, at the end of the series. Additional series are played until at least one competitor completes a series with an aggregate score equal 52 to the predetermined target value 50. If only one competitor finishes a series with an aggregate score 50 equal 52 to the target score, the competitor wins 56. In the event that a competitor scores points on a toss that cause the competitor's aggregate score to exceed 44 the predetermined target value, an "exceeding toss" procedure 46 is optionally applied. Similarly, if two or more competitors complete a series with an aggregate score equal 54 to the target value, a tie procedure such as a playoff series 58 may optionally be applied.

For example, in a game in which the target value is twenty-one, competitor A has nineteen points at the beginning of a series and scores two points on his or her first projectile 10. Competitor A then holds the remaining two projectiles 10 while competitor B tosses his or her three projectiles 10. If competitor B does not score the points needed for an aggregate score of twenty-one or dislodge competitor A's two point projectile 10, competitor A wins after tossing the final two projectiles 10 without exceeding twenty-one or dislodging his or her own two point projectile 10.

In another example, with the same target value, competitor A reaches twenty-one points on a second projectile 10 of a series. Competitor A holds the remaining projectile 10 while competitor B tosses his or her projectiles 10. If competitor B is successful in dislodging one of competitor A's projectiles 10 but is unsuccessful in scoring twenty-one points, another series begins since competitor A did not finish the series with twenty-one points. If competitor B is successful in dislodging one of competitor A's projectiles 10 and in scoring twenty-one points, competitor A is permitted to toss his or her saved projectile 10 to attempt to tie competitor B. In other words, in an optional embodiment, if competitor chooses to hold a projectile 10 after scoring reaching the target value during a series and one of the competitor's projectiles 10 is dislodged from the goal, the competitor is optionally not permitted to toss the held projectile 10 unless another competitor reaches the target value.

In yet another example, competitor A scores twenty-one with projectiles 10 remaining. Competitor B reaches twenty-one on his or her final projectile 10. Competitor A then has the option to use the held projectiles 10 to dislodge one of competitor B's projectiles 10 or go into a playoff round.

In a related example, competitor A scores twenty-one with projectiles 10 remaining. Competitor B reaches twenty-one with projectiles 10 remaining. Competitor A again has the option to toss the held projectiles 10 to dislodge one of competitor B's projectiles 10 or hold the remaining projectiles 10 (perhaps because competitor A does not want to accidentally dislodge one of his or her own projectile 10). However, if competitor A chooses to hold the remaining projectiles 10, competitor B has the option to toss his or her held projectiles 10 to dislodge one of competitor A's projectiles 10 or hold the remaining projectiles 10 as well. If both competitor A and competitor B hold their remaining projectiles 10, a playoff round is conducted.

While certain embodiments of the present invention have been shown and described it is to be understood that the present invention is subject to many modifications and changes without departing from the spirit and scope of the claims presented herein.

We claim:

1. A method of playing a toss game between at least two competitors comprising:

providing at least one projectile comprising two weights connected to one another by a flexible tether;

providing a stand comprising a base resting on a surface and a goal extending upward from said base, said goal including a pair of uprights and at least two crossbars connecting said uprights, each of said crossbars being assigned a point value wherein at least one of said point values is increased if said projectile bounces off said surface before looping over, wrapping, or intersecting a crossbar;

conducting a series of play, said series comprising:

each competitor tossing one or more projectiles at said goal until all competitors have each tossed a predetermined number of projectiles; and calculating an aggregate score for each competitor equal to the aggregate score from a previous series of play, if any, plus the point values for each crossbar a projectile looped over, wrapped, or intersected minus the point values for any projectile dislodged from the stand; and if any competitor has an aggregate score equal to a predetermined target value, declaring the competitor the winner, otherwise, conducting additional series of play until at least one competitor has reached an aggregate score equal to said target value.

2. The method of claim 1 wherein each crossbar is assigned a different point value.

3. The method of claim 2 wherein the point values of each crossbar vary inversely with their distance from said base.

4. The method of claim 1 further comprising:

if, during a series of play, a projectile thrown by a competitor scores a point value that causes the competitor's aggregate score to exceed the target value, not including the point value in calculating the competitor's aggregate score and terminating play for that competitor for the remainder of that series.

5. The method of claim 1 further comprising:

if, during a series of play, a projectile thrown by a competitor scores a point value that causes the competitor's aggregate score to exceed the target value, not including the point value in calculating the competitor's aggregate score and allowing the competitor to continue playing the series until the competitor has thrown the predetermined number of projectiles.

6. The method of claim 1 further comprising:

if, during a series of play, a projectile thrown by a competitor scores a point value that causes the competitor's aggregate score to exceed the target value, not including the point value in calculating the competitor's aggregate score, reducing the competitor's aggregate score by the point value, and terminating play for that competitor for the remainder of that series.

7. The method of claim 1 further comprising:

if, at the completion of a series of play, two or more competitors have an aggregate score equal to the predetermined target value, conducting a playoff series comprising:

each tied competitor tossing a predetermined number of projectiles;

calculating a playoff score equal to the point values for each crossbar a projectile looped over, wrapped, or intersected minus the point values for any projectile dislodged from the stand by another projectile; and declaring the tied competitor with the highest playoff score to be the winner.

8. The method of claim 7 wherein each tied competitor serially tosses a single projectile until all tied competitors have tossed a predetermined number of projectiles.

9. A method of playing a toss game between at least two competitors comprising:

providing a projectile comprising two weights connected to one another by a flexible tether such that the projectile has a total length L;

providing a stand comprising a base and a goal extending upward from said base, said goal including a pair of uprights and at least two crossbars connecting said uprights, each of said crossbars being assigned a point value wherein at least one of said point values is increased if said projectile bounces off said surface before looping over, wrapping, or intersecting a crossbar, said crossbars fixed from one another at a distance greater than or equal to L/2, whereby said projectile is free to wrap around a crossbar without striking an adjacent crossbar in the event that the midpoint of said tether strikes a crossbar when a projectile is tossed at said goal;

conducting a series of play, said series comprising:

each competitor serially tossing a projectile set having one or more projectiles at said goal until all competitors have each tossed a projectile set; and calculating an aggregate score for each competitor equal to the aggregate score from a previous series of play, if any, plus the point values for each crossbar a projectile looped over or wrapped, or intersected if the projectile looped around or wrapped one of said uprights, minus the point values for any projectile dislodged from the stand; and if after completing of a series of play any single competitor has an aggregate score equal to a predetermined target value, declaring the competitor the winner, otherwise, conducting additional series of play until at least one competitor has reached an aggregate score equal to said target value.

10. The method of claim 9 wherein each crossbar is assigned a different point value.

11. The method of claim 10 wherein the point values of each crossbar vary inversely with their distance from said base.

12. The method of claim 9 further comprising:

if, during a series of play, a projectile thrown by a competitor scores a point value that causes the competitor's aggregate score to exceed the target value, not including the point value in calculating the competitor's aggregate score and terminating play for that competitor for the remainder of that series.

13. The method of claim 9 further comprising:

if, during a series of play, a projectile thrown by a competitor scores a point value that causes the competitor's aggregate score to exceed the target value, not including the point value in calculating the competitor's aggregate score and allowing the competitor to continue playing the series until the competitor has thrown the predetermined number of projectiles or reached said target value.

14. The method of claim 9 further comprising:

if, during a series of play, a projectile thrown by a competitor scores a point value that causes the competitor's aggregate score to exceed the target value, not including the point value in calculating the competitor's aggregate score, reducing the competitor's aggregate score by the point value, and terminating play for that competitor for the remainder of that series.

15. The method of claim 9 further comprising:

if, at the completion of a series of play, two or more competitors are tied by having an aggregate score equal to the predetermined target value, conducting a playoff series comprising:

each tied competitor tossing a predetermined number of projectiles;

calculating a playoff score equal to the point values for each crossbar a projectile looped over, wrapped, or intersected minus the point values for any projectile dislodged from the stand; and if one tied competitor has a playoff score greater than all the other tied competitors' playoff scores, declaring the tied competitor with the highest playoff score to be the winner, otherwise, conducting additional playoff series with all tied competitors until one tied competitor has a playoff score greater than all other tied competitors' playoff scores.

16. The method of claim 15 wherein each tied competitor serially tosses a single projectile until all tied competitors have tossed a predetermined number of projectiles.

* * * * *